US010921085B2

(12) United States Patent
McPherson

(10) Patent No.: US 10,921,085 B2
(45) Date of Patent: Feb. 16, 2021

(54) WIDE STRING GROOVE CAM

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 16/516,099

(22) Filed: Jul. 18, 2019

(65) Prior Publication Data

US 2020/0025504 A1 Jan. 23, 2020

Related U.S. Application Data

(60) Provisional application No. 62/700,164, filed on Jul. 18, 2018.

(51) Int. Cl.
*F41B 5/10* (2006.01)

(52) U.S. Cl.
CPC ..... *F41B 5/105* (2013.01)

(58) Field of Classification Search
CPC ..... F41B 5/105
See application file for complete search history.

(56) References Cited

U.S. PATENT DOCUMENTS 4,593,674 A 6/1986 Kudlacek
4,686,955 A 8/1987 Larson
4,748,962 A * 6/1988 Larson ..... F41B 5/10 124/25.6
4,774,927 A 10/1988 Larson
4,838,236 A 6/1989 Kudlacek
4,976,250 A 12/1990 Jeffrey
5,505,185 A * 4/1996 Miller ..... F41B 5/105 124/25.6
6,082,346 A * 7/2000 Andrews ..... F41B 5/10 124/25.6
6,250,293 B1 6/2001 Andrews
6,360,735 B1 3/2002 Larson et al.
6,871,643 B2 3/2005 Cooper et al.
7,690,372 B2 4/2010 Cooper et al.
8,714,143 B1 5/2014 Darlington
2009/0272369 A1* 11/2009 Konczal ..... F41B 5/105 124/25.6

* cited by examiner

*Primary Examiner* — John A Ricci

(74) *Attorney, Agent, or Firm* — Laabs Intellectual Property

(57) ABSTRACT

In some embodiments, an archery bow rotatable member comprises a body arranged to rotate about an axis and a string groove extending around a perimeter of the body. The string groove comprises a first depth portion and a second depth portion. The first depth portion comprises a valley and defines a first width. The second depth portion is oriented above the first depth portion. The second depth portion comprises opposed parallel sidewalls that define a second width greater than the first width.

19 Claims, 8 Drawing Sheets

WIDE STRING GROOVE CAM

CROSS-REFERENCE TO RELATED APPLICATIONS

This application claims the benefit of U.S. Patent Application No. 62/700,164, filed Jul. 18, 2018, the entire content of which is hereby incorporated herein by reference.

BACKGROUND OF THE INVENTION

This invention relates generally to archery bows and more specifically to archery bows having rotating members.

Archery bows are known in the art. Some archery bows include rotating members that are arranged to take-up and/or feed-out cables, for example as a bow is drawn.

In certain archery applications such as hunting, any noise, sound or vibration can be detrimental to the archery experience. If the prey is alerted to the presence of a hunter, the pray will often escape.

There remains a need for novel archery bow configurations that improve performance, improve safety and reduce noise.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow rotatable member comprises a body arranged to rotate about an axis and a string groove comprising a first depth portion and a second depth portion. The first depth portion comprises a valley and defines a first width. The second depth portion extends above the first depth portion and comprises a second width greater than the first width.

In some embodiments, an archery bow rotatable member comprises a body arranged to rotate about an axis and a string groove extending around a perimeter of the body. The string groove comprises a first depth portion and a second depth portion. The first depth portion comprises a valley and defines a first width. The second depth portion is oriented above the first depth portion. The second depth portion comprises opposed parallel sidewalls that define a second width greater than the first width.

In some embodiments, the height of the second depth portion is greater than the height of the first depth portion. In some embodiments, the first depth portion comprises a flared opening. In some embodiments, the second depth portion comprises a flared opening. In some embodiments, a sidewall of the first depth portion comprises an inflection.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
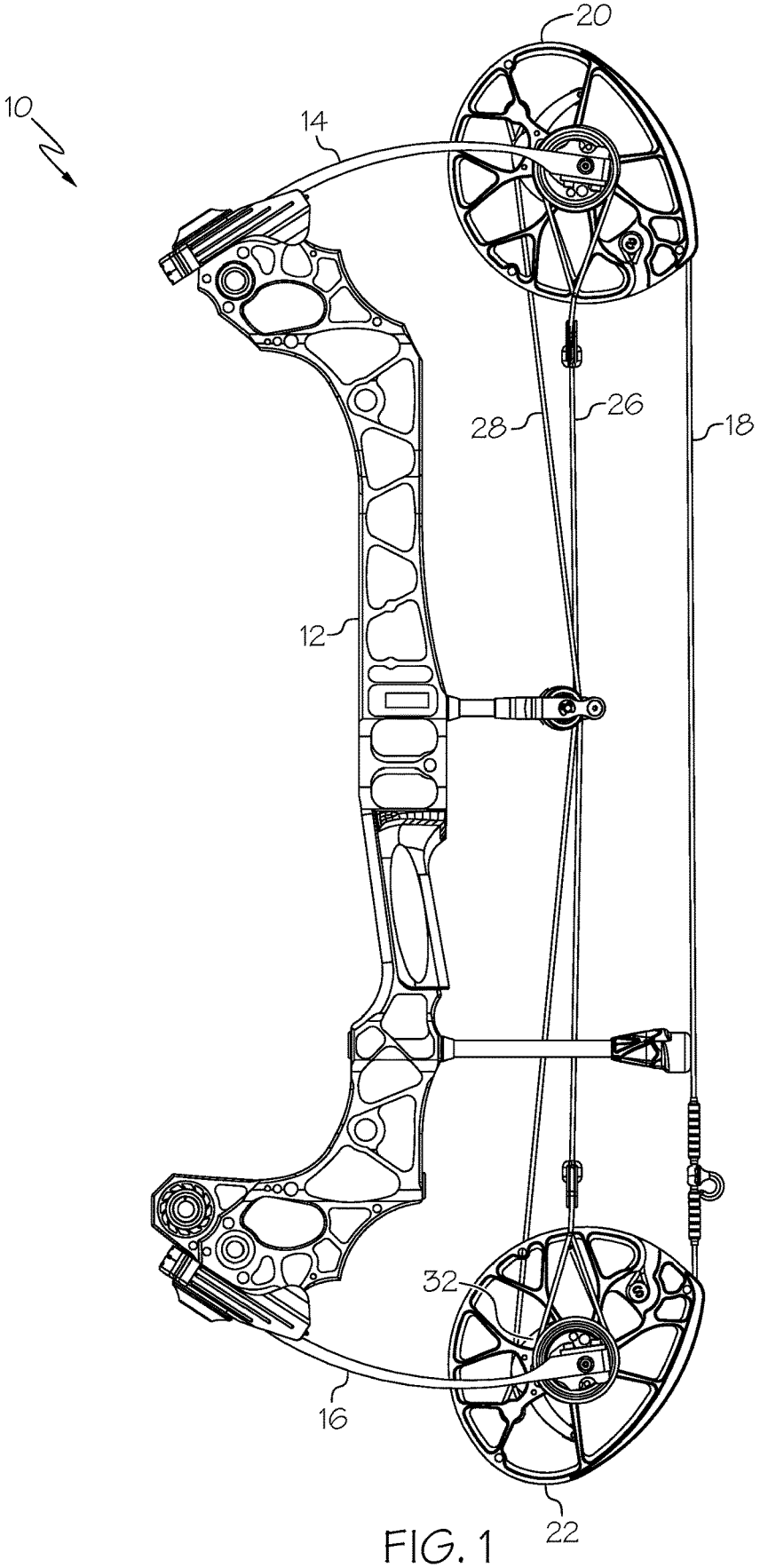
FIG. 1 shows an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10. In some embodiments, a bow 10 comprises a riser 12 and limbs 14, 16. Desirably, the bow 10 comprises a bowstring 18 that can be drawn and released. In some embodiments, a bow 10 comprises a rotatable member 20. In some embodiments, a bow 10 comprises a first rotatable member 20 and a second rotatable member 22. In some embodiments, a bow 10 comprises a compound bow comprising a power cable 26 that is leveraged against the bowstring 18. In some embodiments, a rotatable member 22 comprises a cam track 32, and the power cable 26 is taken up in the cam track 32 as the bow 10 is drawn. In some embodiments, the bow 10 comprises a second power cable 28.

Figure 2:
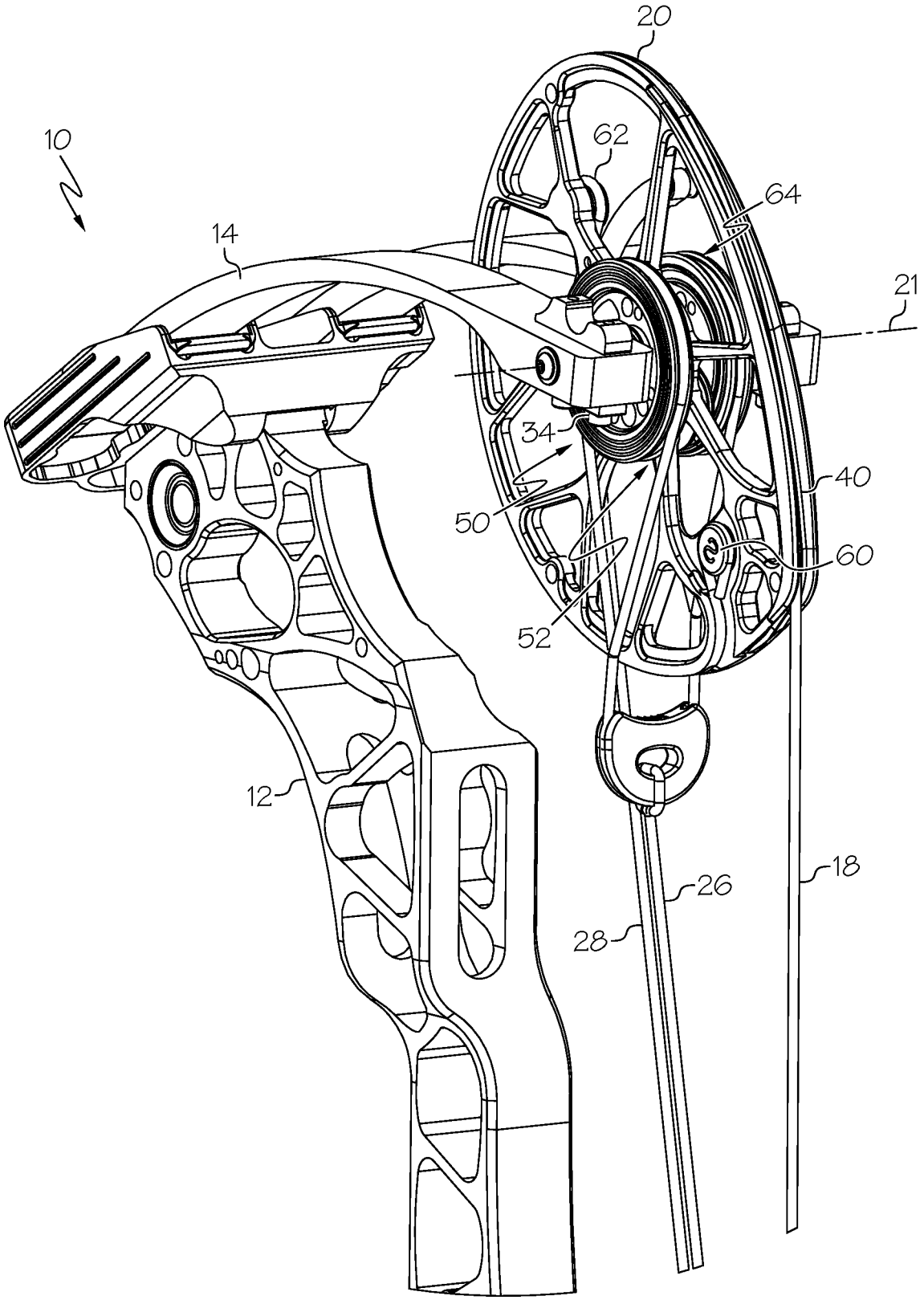
FIG. 2 shows another view of the bow of FIG. 1.
Figure 3:
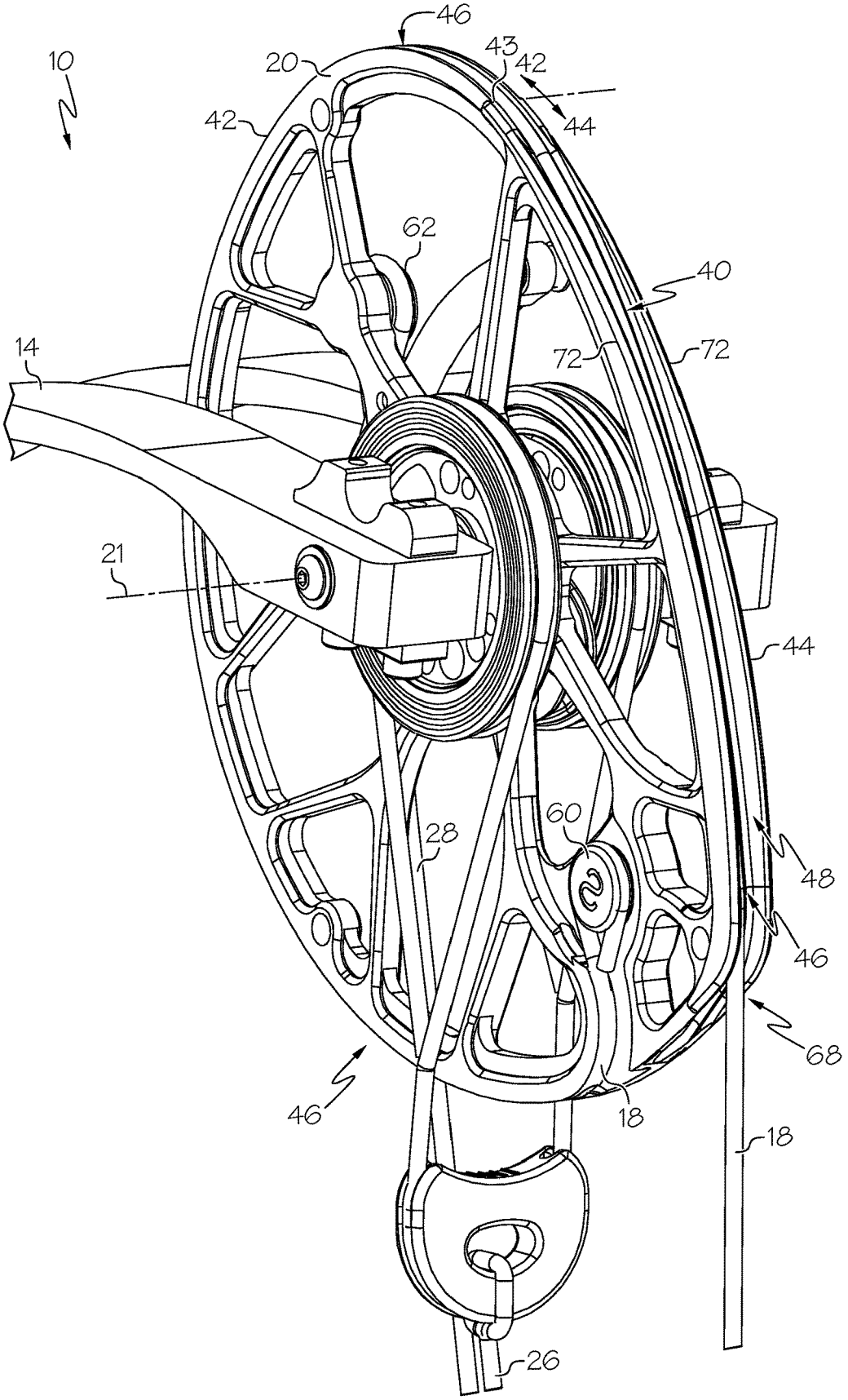
FIG. 3 shows a more detailed view of an embodiment of a rotatable member of the bow.

FIGS. 2 and 3 show additional views of the bow 10 of FIG. 1. In some embodiments, the rotatable member 20 is supported by the limb 14. Desirably, the rotatable member 20 is arranged to rotate about an axis 21. In some embodiments, as the bow 10 is drawn, the rotatable member 20 rotates. During rotation, the rotatable member 20 feeds out bowstring 18 and takes up a power cable 28. In some embodiments, a rotatable member 20 is engages with three string and/or cable segments. As shown in FIGS. 2 and 3, the rotatable member 20 will feed out bowstring 18 and take up the second power cable 28 as the bow 10 is drawn. The first power cable 26 is attached to the rotatable member 20 via a force vectoring anchor 34, for example as described in U.S. Pat. No. 8,020,544, the entire content of which is hereby incorporated herein by reference.

In some embodiments, a rotatable member 20 comprises a string groove 40. In some embodiments, the bowstring 18 is oriented in the string groove 40. In some embodiments, the bowstring 18 is fed out from the string groove 40 when the bow 10 is drawn and taken up by the string groove 40 as the bow 10 fires an arrow.

In some embodiments, the rotatable member 20 comprises a first cable groove 50. In some embodiments, the first cable groove 50 is arranged to take up a power cable (e.g. second power cable 28) as the bow 10 is drawn. In some embodiments, the rotatable member 20 comprises a second cable groove 52. In some embodiments, a power cable (e.g. first power cable 26) is engaged with the second cable groove 52.

In some embodiments, the rotatable member 20 comprises a first terminal post 60. In some embodiments, an end of the bowstring 18 is attached to the first terminal post 60. In some embodiments, the rotatable member 20 comprises a second terminal post 62. In some embodiments, a power cable (e.g. second power cable 28) is attached to the second terminal post 62. In some embodiments, the rotatable member 20 comprises a third terminal post and a power cable (e.g. first power cable 26) is engaged with the third terminal post. As shown in FIG. 2, an end of the first power cable 26 is engaged with the force vectoring anchor 34, and the force vectoring anchor 34 acts as a third terminal post 64.

FIG. 3 shows the bow 10 in the undrawn orientation and depicts how the bowstring 18 can occupy the string groove 40.

In some embodiments, the string groove 40 extends around an outer periphery of the rotatable member 20. In some embodiments, the string groove 40 comprises a first length portion 42 and a second length portion 44. In some embodiments, the first length portion 42 comprises a first depth portion 46. In some embodiments, the second length portion 44 comprises the first depth portion 46 and a second depth portion 48. In some embodiments, the second depth portion 48 is located above, or radially outwardly from, the first depth portion 46 and provides a greater depth to the string groove 40. A greater depth can help contain the bowstring 18 after firing the bow. In some embodiments, the second depth portion 48 comprises a greater width than the first depth portion 46, which provides greater lateral clearance for the bowstring 18. In some embodiments, lateral spacing between the sidewalls of the second depth portion 48 and the bowstring 18 reduce noise, both during firing but also as the bowstring 18 is initially drawn.

Figure 4:
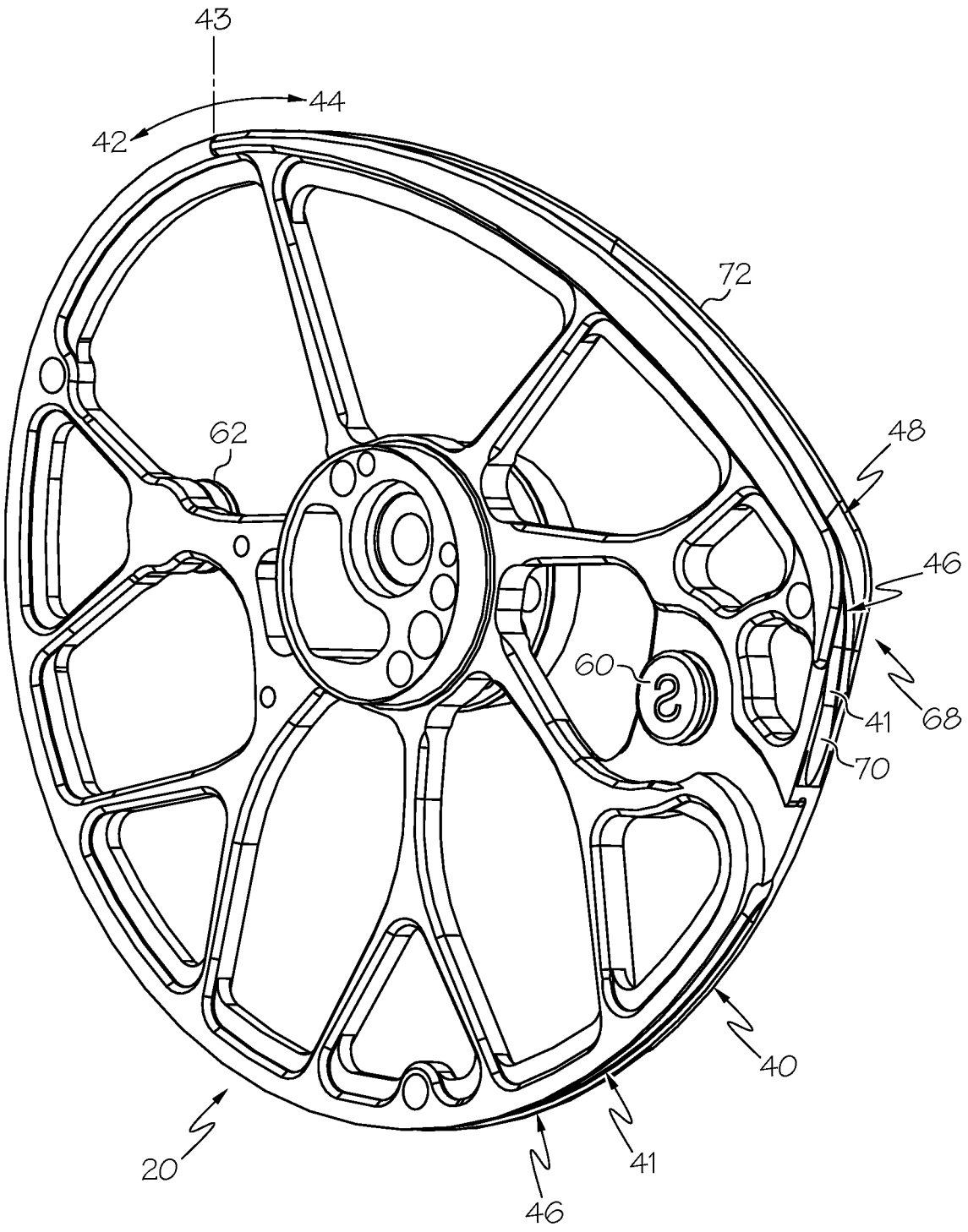
FIG. 4 shows an embodiment of a rotatable member.
Figure 5:
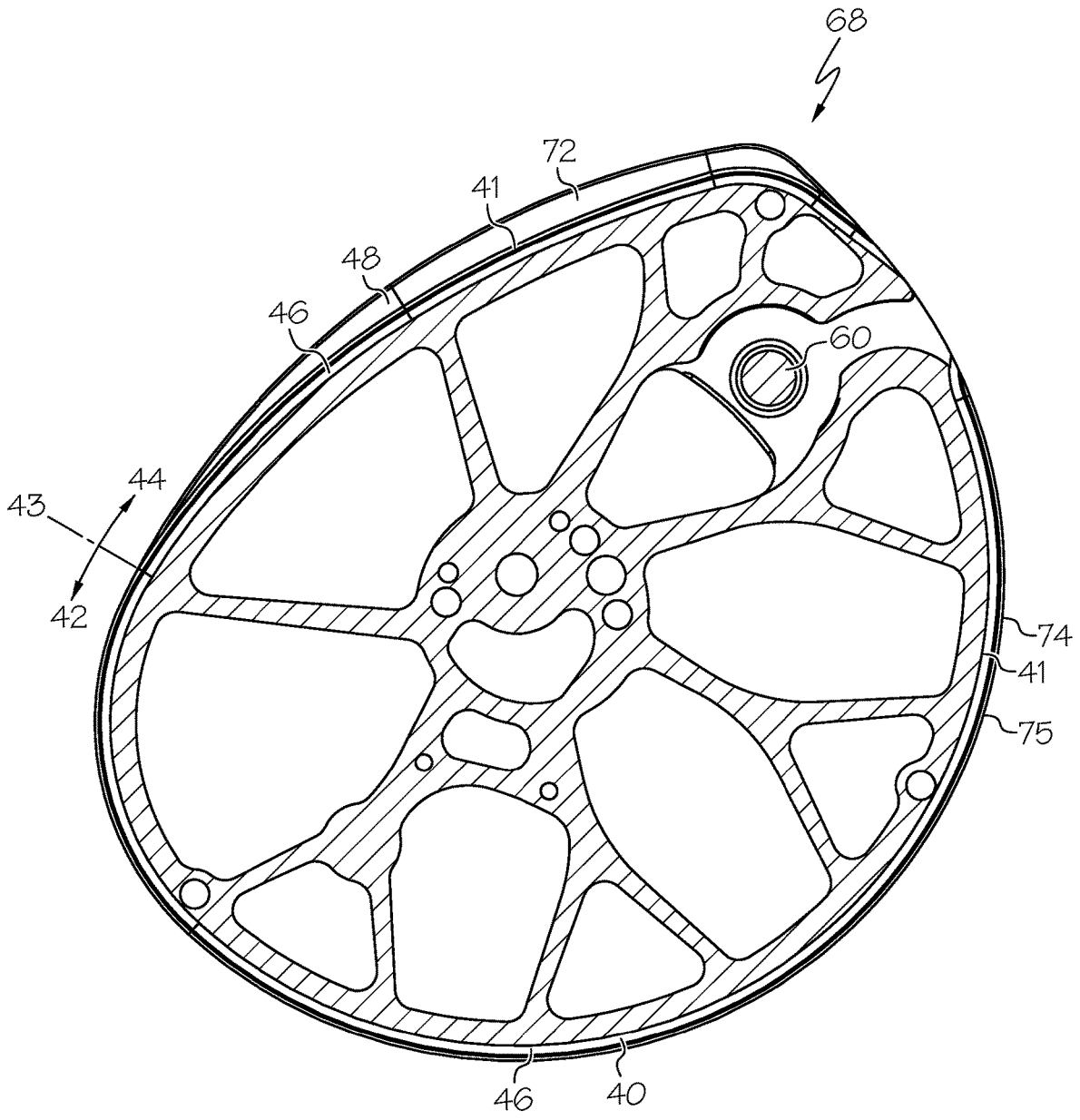
FIG. 5 shows a sectional view of an embodiment of a rotatable member.
Figure 6:
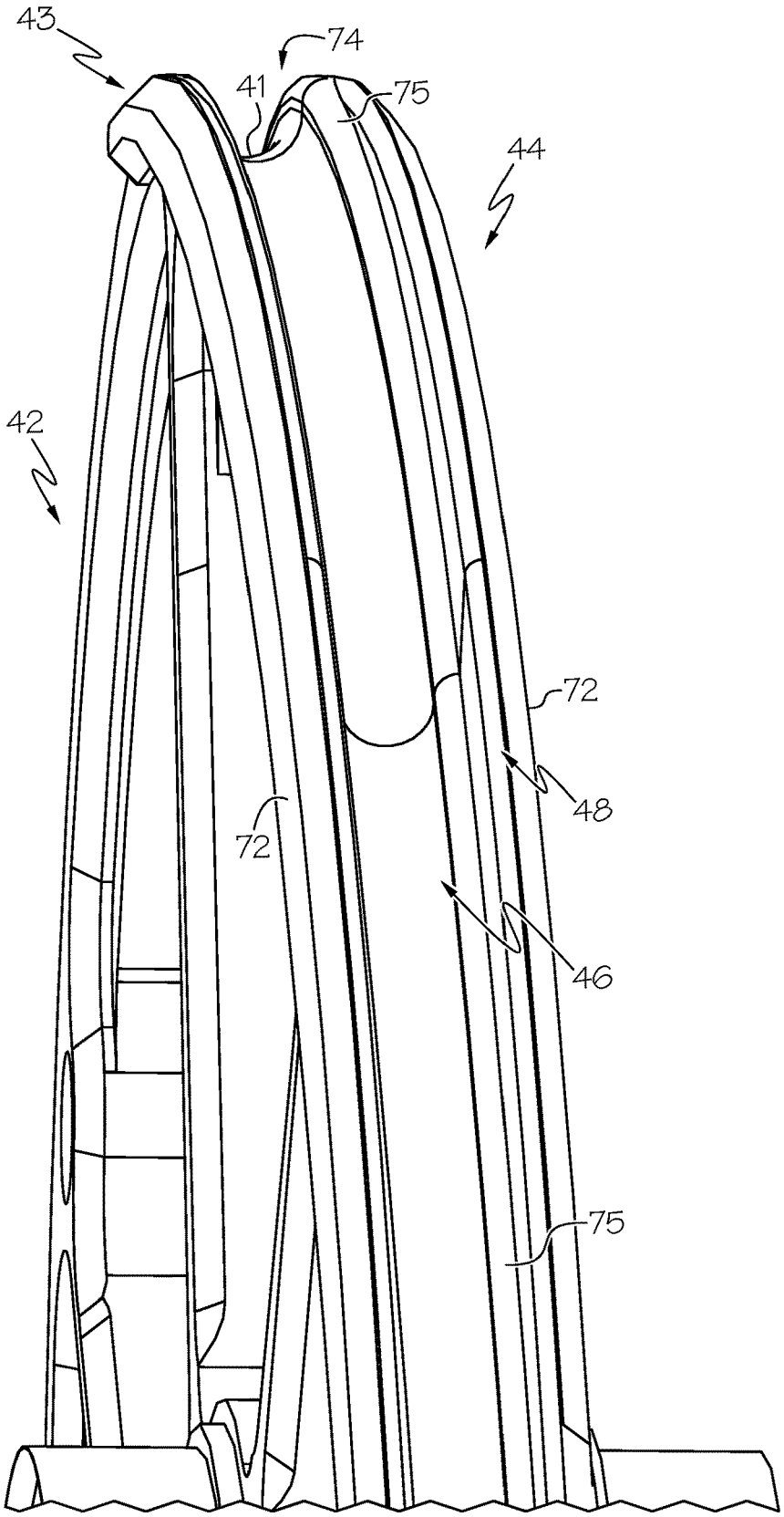
FIG. 6 shows a detail of an embodiment of a string groove.
Figure 7:
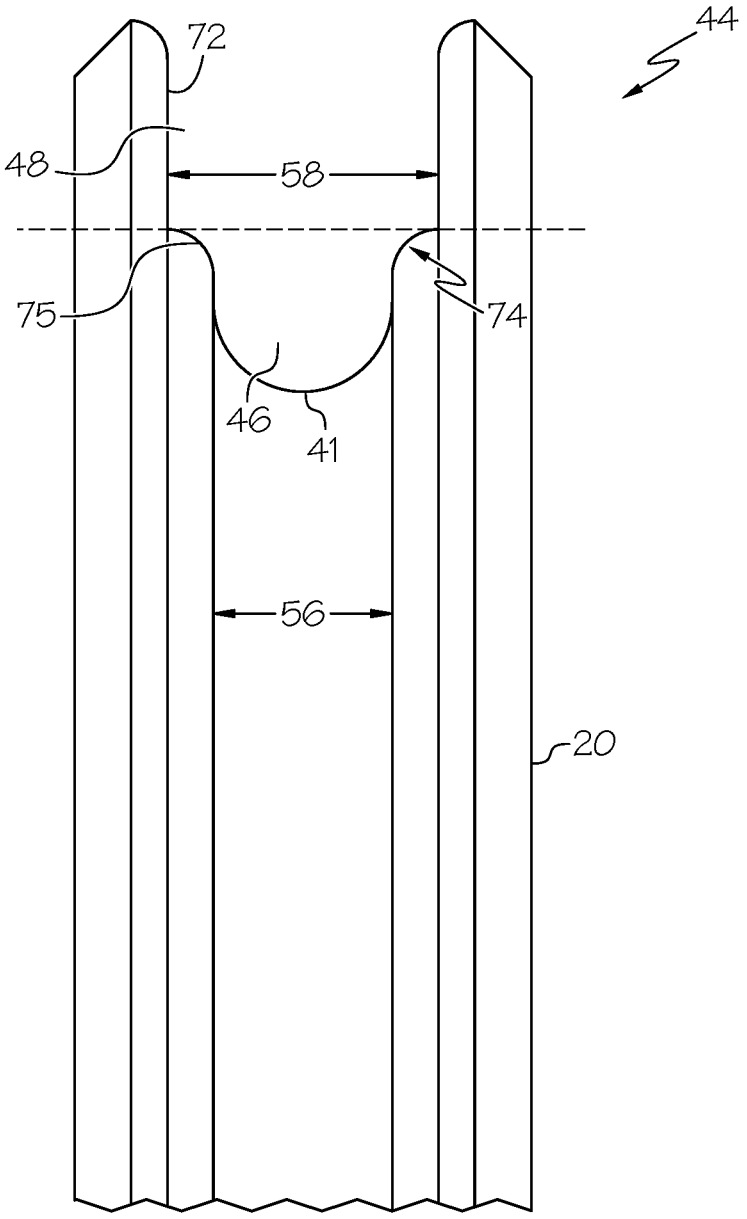
FIG. 7 shows a detail of portions of an embodiment of a string groove.

FIG. 4 shows an embodiment of a rotatable member 20 without strings or cables. FIG. 5 shows a sectional view of an embodiment of a rotatable member 20. FIG. 6 shows a detailed view of an embodiment of a rotatable member 20 showing the width and depth of the string groove 40 growing as the second length portion 44 is traversed. FIG. 7 shows a detailed view of a portion of a string groove 40.

With reference to FIGS. 3-7, in some embodiments, a string groove 40 extends from a first terminal post 60 about an outer perimeter of the rotatable member 20. In some embodiments, the string groove 40 occupies a majority of the perimeter of the rotatable remember 20. In some embodiments, the string groove 40 extends past a bowstring exit location 68 where the bowstring 18 exits the string groove 40 when the bow 10 is not drawn. In some embodiments, the string groove 40 comprises a first length portion 42, a second length portion 44 and a transition 43.

In some embodiments, the first length portion 42 extends from the first terminal post 60 to the transition 43. In some embodiments, the first length portion 42 does not include the bowstring exit location 68.

In some embodiments, the second length portion 44 extends from the transition 43 to an end 70 of the string groove 40. In some embodiments, the second length portion 44 comprises the bowstring exit location 68. In some embodiments, the second length portion 44 does not include the first terminal post 60.

In some embodiments, the string groove 40 comprises a valley 41, and the bowstring 18 rests in the string groove 40 in contact with the valley 41. In some embodiments, the valley 41 extends continuously across the transition 43 from the first length portion 42 to the second length portion 44.

In some embodiments, the first length portion 42 of the string groove 40 comprises a predetermined cross-sectional shape. In some embodiments, the cross-sectional shape remains substantially constant along the length of the first length portion 42. In some embodiments, the first depth portion 46 comprises a predetermined cross-sectional shape. In some embodiments, the first depth portion 46 extends across the transition 43 and continues along the length of the second length portion 44. In some embodiments, a shape of the first depth portion 46 remains constant across the transition 43 and into the second length portion 44.

In some embodiments, the first depth portion 46 comprises a curved valley. In some embodiments, the first depth portion 46 comprises opposed sidewalls. In some embodiments, portions of the opposed sidewalls of the first depth portion 46 extend parallel to one another. In some embodiments, the first depth portion 46 comprises a flared opening 74, wherein the opening 74 is wider than a width 56 defined between sidewalls of the first depth portion 46. In some embodiments, the flared opening 74 comprises curved portions 75 of sidewalls that define the first depth portion 46. In some embodiments, each of the opposed sidewalls of the first depth portion 46 comprise an inflection. For example, in some embodiments, the valley 41 surface is concave and the flared opening 74 is convex, and the sidewall comprises an inflection located between the convex portion and concave portion.

In some embodiments, the second depth portion 48 is positioned above, or radially outward from, the first depth portion 46. In some embodiments, the second depth portion 48 is defined by raised flanges 72. In some embodiments, the raised flanges 72 comprise first and second flanges defining opposite sides of the second depth portion 48. In some embodiments, the raised flanges 72 extend from the transition 43 to the bowstring exit location 68. In some embodiments, a depth of the second depth portion 48 increases as the second length portion 44 is traversed away from the transition 43.

In some embodiments, the second depth portion 48 comprises a width 58 that is greater than a width 56 of the first depth portion 46. In some embodiments, any width 58 of the second depth portion 48 is greater than the width 56 of the first depth portion 46. In some embodiments, a width 58 of the second depth portion 48 is greater than a distance across a flared opening 74 of the first depth portion 46. In some embodiments, the width 58 of the second depth portion 48 is equal to or greater than 1.25 times the width 56 of the first depth portion 46. In some embodiments, the width 58 of the second depth portion 48 is equal to or greater than 1.5 times the width 56 of the first depth portion 46.

In some embodiments, a depth of the second depth portion 48 can have any suitable positive value. In some embodiments, a depth of the second depth portion 48 is less than a depth of the first depth portion 46. In some embodiments, a depth of the second depth portion 48 is approximately equal to a depth of the first depth portion 46. In some embodiments, a depth of the second depth portion 48 is greater than a depth of the first depth portion 46. In some embodiments, a depth of the second depth portion 48 is at least 1.25 times the depth of the first depth portion 46. In some embodiments, a depth of the second depth portion 48 is at least 1.5 times the depth of the first depth portion 46.

In some embodiments, the second depth portion 48 comprises a flared opening 74, wherein the opening 74 is wider than the width 58 defined between sidewalls of the second depth portion 48. In some embodiments, the flared opening 74 comprises curved portions 75 of sidewalls that define the second depth portion 48.

In some embodiments, the bowstring 18 comprises a predetermined diameter. In some embodiments, a depth of the first depth portion 46 is approximately equal to the diameter of the bowstring 18. In some embodiments, a depth of the first depth portion 46 is greater than the diameter of the bowstring 18. In some embodiments, a depth of the second depth portion 48 is approximately equal to the diameter of the bowstring 18. In some embodiments, a depth of the second depth portion 48 is greater than the diameter of the bowstring 18. In some embodiments, a depth of the second depth portion 48 is at least 1.25 times the diameter of the bowstring 18. In some embodiments, a depth of the second depth portion 48 is at least 1.5 times the diameter of the bowstring 18.

In some embodiments, the first length portion 42 does not include a second depth portion 48.

Figure 8:
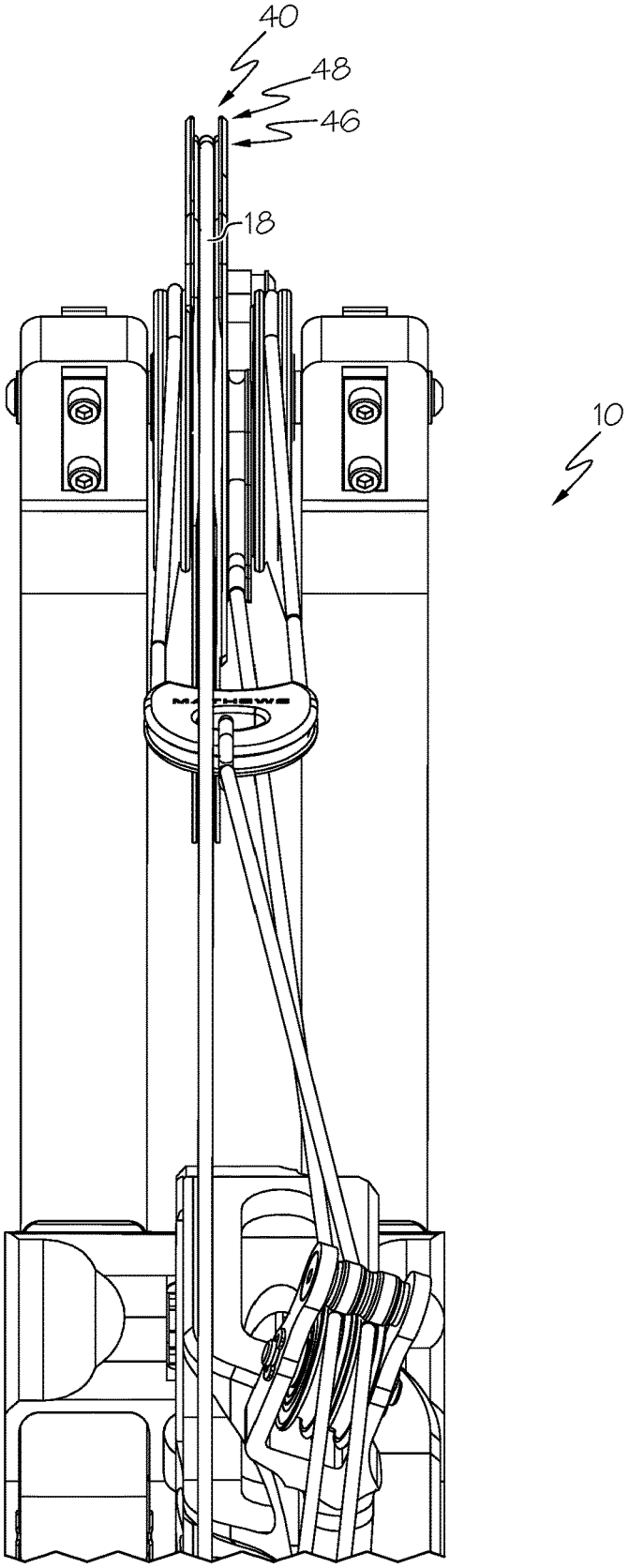
FIG. 8 shows a view of an embodiment of a bow showing the bowstring occupying the string groove.

FIG. 8 shows a view of an embodiment of a bow 10 showing the bowstring 18 occupying the string groove 40.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow rotatable member comprising:

a body arranged to rotate about an axis;

a string groove comprising a first depth portion and a second depth portion, the first depth portion comprising a valley and having a first width, the second depth portion extending above the first depth portion, the second depth portion comprising a second width greater than the first width;

wherein a depth of the second depth portion increases along a length portion of the string groove.

2. The archery bow rotatable member of claim 1, the second depth portion defined by opposing sidewalls.

3. The archery bow rotatable member of claim 2, the opposing sidewalls extending parallel to one another.

4. The archery bow rotatable member of claim 2, the opposing sidewalls diverging as the second depth portion is traversed in a direction away from the valley.

5. The archery bow rotatable member of claim 1, the string groove comprising a first length portion and a second length portion, the first depth portion extending from the first length portion to the second length portion.

6. The archery bow rotatable member of claim 5, wherein the first length portion does not comprise the second depth portion.

7. The archery bow rotatable member of claim 5, the string groove comprising a first end portion and a second end portion, the second end portion comprising a bowstring exit location, the second length portion extending to the bowstring exit location.

8. The archery bow rotatable member of claim 1, wherein the first depth portion comprises a flared opening.

9. The archery bow rotatable member of claim 1, wherein a sidewall of the first depth portion comprises an inflection.

10. An archery bow rotatable member comprising:

a body arranged to rotate about an axis;

a string groove comprising a first depth portion and a second depth portion, the first depth portion comprising a valley and having a first width, the second depth portion extending above the first depth portion, the second depth portion comprising a second width greater than the first width;

a sidewall of the string groove comprising a first wall portion and a second wall portion, the first depth portion comprising the first wall portion, the second depth portion comprising the second wall portion, the first wall portion offset from the second wall portion.

11. The archery bow rotatable member of claim 10, wherein a depth of the second depth portion increases along a length portion of the string groove.

12. The archery bow rotatable member of claim 10, the sidewall comprising a curved portion located between the first wall portion and the second wall portion.

13. The archery bow rotatable member of claim 10, wherein the first depth portion comprises a flared opening.

14. The archery bow rotatable member of claim 10, wherein a sidewall of the first depth portion comprises an inflection.

15. An archery bow rotatable member comprising:

a body arranged to rotate about an axis;

a string groove extending around a perimeter of the body, the string groove comprising a first depth portion and a second depth portion, the first depth portion comprising a valley and having a first width, the second depth portion oriented above the first depth portion, the second depth portion comprising opposed parallel sidewalls that define a second width greater than the first width;

wherein the first depth portion comprises a flared opening.

16. The archery bow rotatable member of claim 15, wherein a height dimension of the string groove comprises a height of the first depth portion combined with a height of the second depth portion, the height of the second depth portion being greater than the height of the first depth portion.

17. The archery bow rotatable member of claim 15, wherein the second depth portion comprises a flared opening.

18. The archery bow rotatable member of claim 15, wherein a sidewall of the first depth portion comprises an inflection.

19. The archery bow rotatable member of claim 15, wherein a depth of the second depth portion increases along a length portion of the string groove.

* * * * *